US006138438A

United States Patent [19]

Michell et al.

[11] Patent Number: 6,138,438

[45] Date of Patent: Oct. 31, 2000

[54] METHOD AND APPARATUS FOR AUTOMATICALLY PLACING SHEETS OF PLASTIC FROM A ROLL ONTO THE SECOND TOP TIER OF A LUMBER PACKAGE

[75] Inventors: Steven W. Michell; Bert Andersson; Gord Newnes; Paul Halper, all of Salmon Arm, Canada

[73] Assignee: CAE Electronics Ltd., St. Laurent, Canada

[21] Appl. No.: 09/110,190

[22] Filed: Jul. 6, 1998

[30] Foreign Application Priority Data

Jul. 4, 1997 [CA] Canada ..... 2209812

[51] Int. Cl.[7] ..... B65B 11/00

[52] U.S. Cl. ..... 53/397; 53/157; 53/389.3; 53/447; 53/593

[58] Field of Search ..... 53/397, 447, 157, 53/389.3, 389.5, 389.4, 66, 389.2, 593; 83/56, 614

[56] References Cited

U.S. PATENT DOCUMENTS

| | | | |
|---|---|---|---|
| 3,664,089 | 5/1972 | Keck | 53/157 X |
| 3,693,318 | 9/1972 | Balzer et al. | 53/389.3 X |
| 3,893,279 | 7/1975 | Bostrom | 53/461 X |
| 4,941,374 | 7/1990 | Focke | 53/157 X |
| 5,699,646 | 12/1997 | Hammer | 53/447 X |

*Primary Examiner*—James F. Coan
*Attorney, Agent, or Firm*—Antony C. Edwards

[57] ABSTRACT

An apparatus for automatically placing lengths of poly sheet from a roll of poly sheet onto the second-from-the-top tier of a lumber package includes a poly roll holder, and a plurality of grip clamps. The grip clamps may have rubber pads for improved friction when gripping the POLY sheet. The gripping clamps are mounted on a carriage which is in turn mounted on a trolley. The trolley is selectively translated back and forth over an exposed tier in a stack of lumber. The gripping clamps grasp the free end of the poly sheet so that the ploy sheet is drawn over the exposed tier as the trolley is translated.

28 Claims, 8 Drawing Sheets

METHOD AND APPARATUS FOR AUTOMATICALLY PLACING SHEETS OF PLASTIC FROM A ROLL ONTO THE SECOND TOP TIER OF A LUMBER PACKAGE

CROSS REFERENCE TO RELATED APPLICATION

This application claims priority from Canadian Patent Application No. 2,209,812 filed Jul. 4, 1997 titled Method And Apparatus For Automatically Placing Sheets Of Plastic From A Roll Onto The Second Top Tier Of A Limber Package.

FIELD OF THE INVENTION

This invention relates to a method and apparatus for automatically placing sheets of plastic from a roll onto a tier of a lumber package, and in particular relates to the placement of various lengths of sheet plastic pulled from a roll, cut off and placed onto a second from the top is tier of a lumber package.

BACKGROUND OF THE INVENTION

In the prior art, better described below, a package of lumber is strapped and the top tier and sides covered with a standard sheet. The package is then stacked for storage and shipping. Thus, the problem arises in the prior art that the sheet can be torn by stacking equipment or the shifting of a load during shipping thereby allowing rain water to leak into the lumber when stored in the open, causing the lumber to stain or begin to rot.

In particular, in the prior art, applicant is aware of U.S. Pat. No. 4,043,085 issued to Ochiai, which describes a sheet cover construction, of the type which is commonly used to cover the entire top and sides of lumber packages.

To address the above described problem, it is an object of the present invention to provide a method and apparatus that will enhance the present method of lumber package covering by applying a plastic sheet (herein after referred to as poly sheet), to the top of the second-from-the-top tier during the stacking of a lumber package, that is, just before finishing of the stacking, and before strapping and the final covering.

It is also an object of the present invention to provide a primary water protection, to allow protection of the majority of the lumber in a package, in cases where no other covering is applied to the completed lumber package.

SUMMARY OF THE INVENTION

The apparatus for automatically placing lengths of poly sheet from a roll of poly sheet onto the second-from-the-top tier of a lumber package consists of a poly roll holder, a gripping means for gripping the poly sheet consisting of a plurality of grip clamps. The grip clamps may have rubber pads (or other material) for improved friction when gripping the ploy sheet. The gripping means is mounted on a carriage means, which is in turn mounted on a trolley means. The trolley means is translated back and forth over the exposed tier in a stack of lumber by a selective translation means, which is automatically or semi-automatically controlled. The gripping means grasps the free end of the poly sheet so that the ploy sheet is drawn over the exposed tier as the trolley is translated.

Alternatively, a vacuum applicator instead of grip clamps may be used to grip the poly to be drawn across the package. A vacuum supply conduit has a valve means to allow for selective gripping and releasing of poly sheet at the vacuum applicator as the sheet is drawn over the package.

A cutting means for cutting the poly sheet is provided. A pre-tension means for tensioning the poly sheet for ease of cutting assists cutting the poly sheet after it has been drawn to a desired length. The poly cutting means consists of an actuable cylinder (or other means) for shuttling a knife and the pre-tensioning means across the poly sheet to cut the poly sheet and then return ready to cut the next sheet. A second knife and poly sheet pre-tension means may be installed on the same cylinder so as to allow cutting of poly sheet on the return stroke. A knife holder may be employed to hold standard razor blades for cutting engagement with the poly sheet.

Alternatively, the poly sheet may be cut by the use of a hot wire. The hot wire is rotated through the poly sheet by an arm arrangement that holds the hot wire taut while allowing it to be rotated down through poly sheet. Further, alternatively, the poly sheet may be depressed down onto the hot wire when the hot wire is mounted adjacent to the poly sheet.

Adjustable tabs may be used to pre-set the desired length of poly sheet. The tabs are adjustably mounted along a horizontal frame. A sensing means translates with the trolley means. The sensing means senses the adjustable tabs and causes trolley means, carriage and gripping means to pause at the desired length so as to allow for the cutting means to cut the poly sheet to length. The adjustable tabs may be placed every 2 feet along the length of the frame above the lumber package. When the length of the lumber is known, and before the plastic sheet is placed, the tabs corresponding to the correct length may be manually set to engage the sensing means.

A carriage drive means, such as a variable speed electric motor advantageously provides for ramping up of the motor speed (and thus provides for ramping up of the translation speed) so as to inhibit slippage between the poly sheet and the gripping means, and ramping down of the motor prior to reaching desired length of poly sheet to be cut, to thereby inhibit the roll of poly sheet from unravelling due to its rotational momentum, such as might occur if the carriage and gripping means were stopped abruptly during translation. One way this is accomplished is engaging the adjustable tabs with the sensing means sufficiently prior to the desire length of plastic sheet being reached during translation of the trolley means to allow for ramping down of the translation speed.

An alternative to this measuring means could be the use of an encoder mounted on the carriage drive means, which would track the length of poly as the poly is being drawn out.

A roll braking means is provided consisting of a weighted length of belt. The weight may be attached to the end of the belt. The belt is attached to the front of the poly roll holder and is draped over the roll to apply a constant pressure onto the top of the roll, thus functioning as a braking or dampening mechanism to assist slowing the rotational momentum of the roll once the poly sheet has been drawn to the desired length.

An overhead air conduit may be provided. The air conduit may have a valve means which is activated as the poly sheet is cut and as the gripping means releases the free end of the poly sheet. The overhead air conduit directs a stream of air onto the poly sheet to assist settling the sheet on top of the package. This air between the poly sheet and the package is forced out from beneath the poly sheet before the last (that is, uppermost) tier is stacked on top of the poly sheet.

Nozzles may be employed to apply the air stream over a wide area for optimum coverage. An air accumulator may also be used to store a reservoir of air allowing for quick dispersal.

In an alternative embodiment to the above described apparatus, the roll of poly sheet may be mounted on the opposite end of the frame, where the poly sheet may be pulled out to length, then cut. On lumber packages of shorter length, the cut length of poly sheet may be pulled further on to reach the end of the package. That is, the sheet is cut to the correct length corresponding to the shorter length of the lumber package, and then dragged along the length of the frame to reach and cover, the shorter lumber package at the other end of the frame. This arrangement would provide more access room at the end of the package (operator's side), in the event of a tier being skewed.

It is within the scope of this invention to place the poly sheet onto the second last tier as the tier is formed, before the tier is placed onto the lumber package. In this embodiment stacker forks carrying the tier have to be slowed so as to prevent the poly from drifting out of position on the top of the tier as the tier is being placed.

In summary, the sheet placer of the present invention for selectively unrolling and cutting water impervious sheet over a tier of lumber on a lumber stacker, includes means for rotatably supporting a roll of water impervious sheet over a first end of the tier of lumber so as to align a free end of the roll generally parallel to the first end of the tier of lumber. Clamping means selectively grasp the free end of the roll and selectively translate the free end of the roll over the tier of lumber between the first and a second end of the tier. Cutting means cutting the water impervious sheet at the first end of the tier of lumber. The cutting means is selectively directed in cutting engagement across the water impervious sheet generally parallel to the first end of the tier of lumber.

Advantageously, the means for selectively grasping the free end of the roll is a spaced apart array of selective clamping means spaced laterally across the free end of the roll. Further advantageously, the clamping means are clam shell clamps having opposed resilient friction pads mounted therein for selective clamping by the clam shell clamps onto the free end of the roll, whereby the free end of the roll is selectively held within the clamping means frictionally between the opposed resilient friction pads.

In one aspect of the invention, the cutting means for cutting the water impervious sheet is a blade means, wherein the blade means comprises a generally planar member having a leading edge thereof engageable with the water impervious sheet so as to tension the water impervious sheet over the leading edge and so as to engage a blade mounted on the blade means in co-planar relationship with the leading edge. The water impervious sheet is tensioned by the leading edge when the blade means is translated in cutting engagement across the water impervious sheet. In a second aspect, the leading edge and the blade are contiguous and form first and second angles respectively relative to a plane containing the water impervious sheet, and wherein the first angle is less than the second angle. In a third aspect, the cutting means may comprise a hot wire.

In a further aspect, anti-billowing means are provided for flattening the water impervious sheet onto the tier of lumber as the free end of the roll is translated between the first and second ends of the tier of lumber, wherein the anti-billowing means may comprise air directing means for directing pressurized air onto a surface of the water impervious sheet opposite to the tier of lumber.

A further aspect of the invention, for use on a lumber stacker is, a method for selectively unrolling and cutting water impervious sheet over a tier of lumber on a lumber stacker, where the tier of lumber has first and second opposite tier ends. The method includes the steps of mounting a means for rotatably supporting a roll of water impervious sheet over the first end of the tier of lumber so as to align a free end of the roll so mounted generally parallel to the first and second ends of the tier of lumber; selectively grasping, by clamping means, the free end of the roll and selectively translating the free end of the roll over the tier of lumber between the first and second ends; cutting, by cutting means, the water impervious sheet at the first end of the tier of lumber; and directing a means for selectively directing the cutting means into cutting engagement across the water impervious sheet generally parallel to the first end of the tier of lumber.

BRIEF DESCRIPTION OF THE DRAWINGS

The invention will be better understood by reference to the drawings, wherein.

Figure 1:
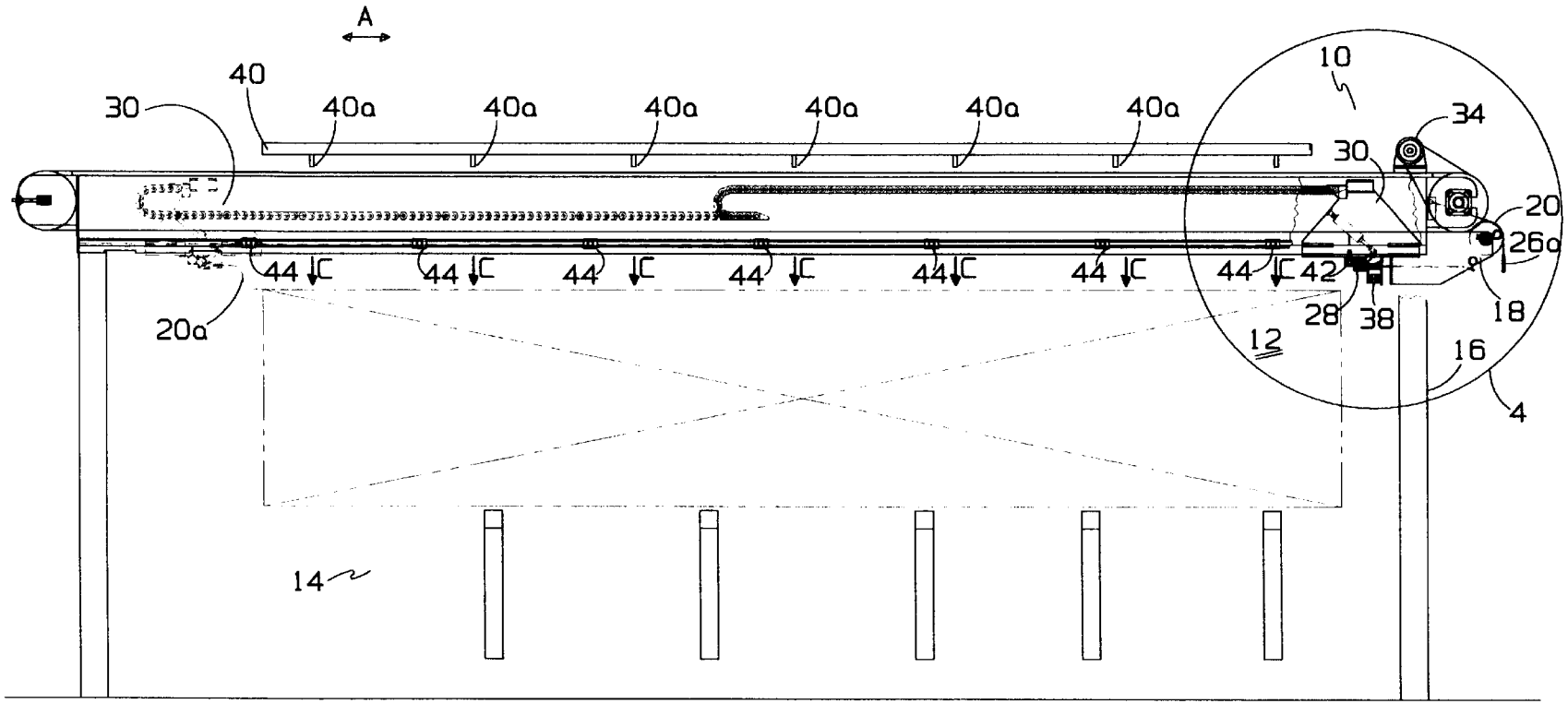
FIG. 1 is a side elevation view according to a preferred embodiment of the invention.

The invention provides other advantages which will be made clear in the description of the preferred embodiments.

DETAILED DESCRIPTION OF PREFERRED EMBODIMENTS

Referring to the drawing figures wherein similar characters of reference represent corresponding parts in each view, the poly sheet placing apparatus is generally indicated by the reference number 10.

Figure 2:
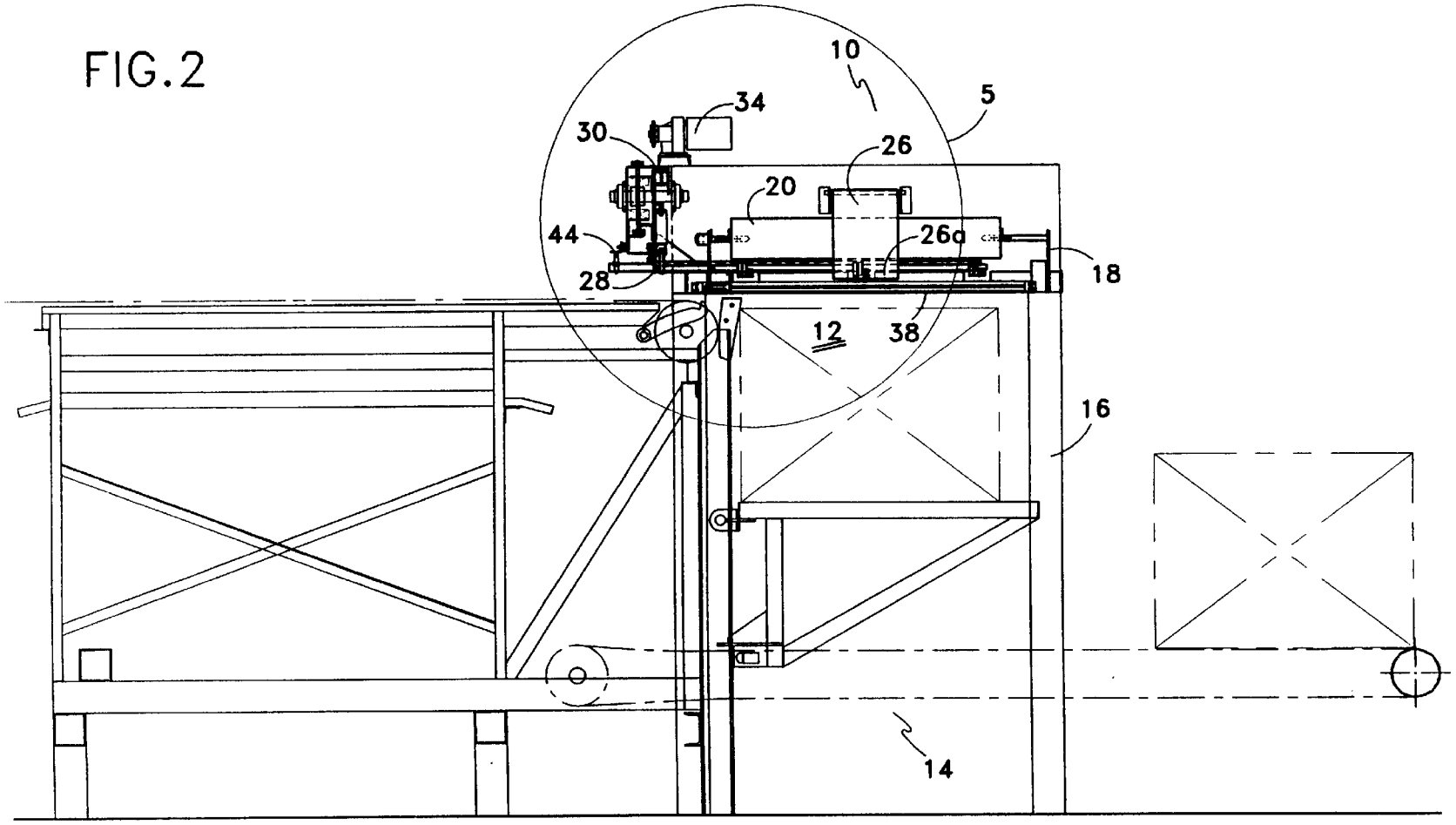
FIG. 2 is an end elevation view according to a preferred embodiment of the invention.
Figure 3:
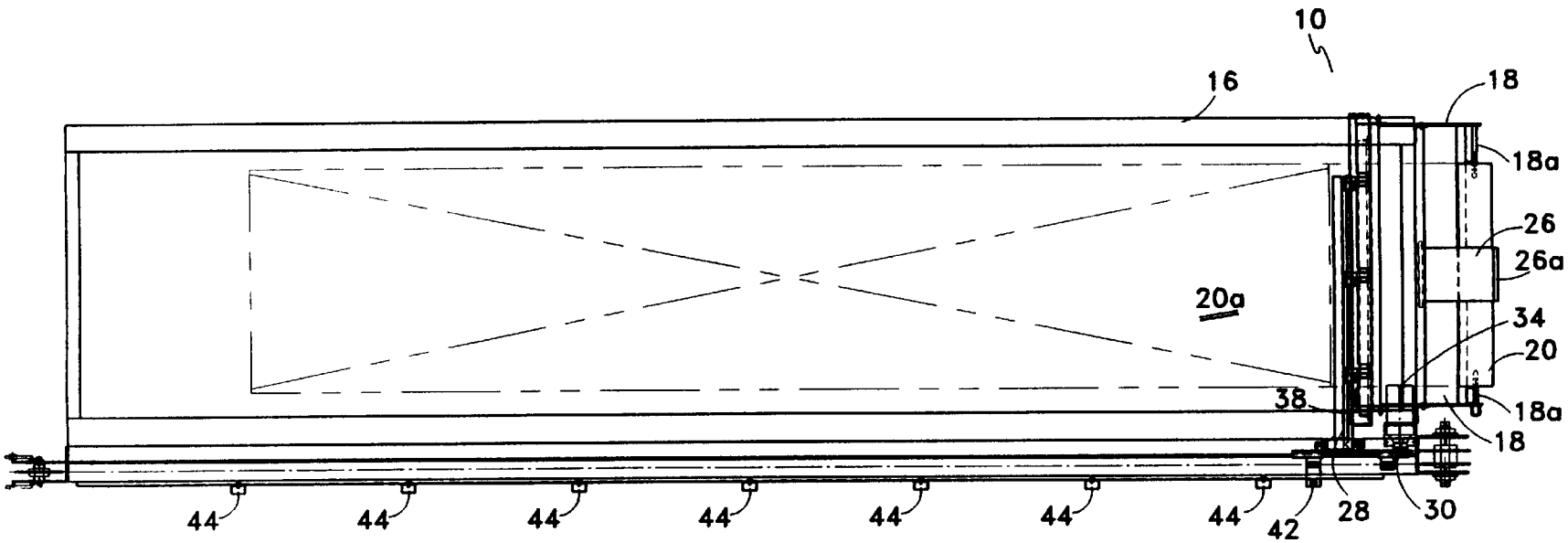
FIG. 3 is a plan view according to a preferred embodiment of the invention.
Figure 4:
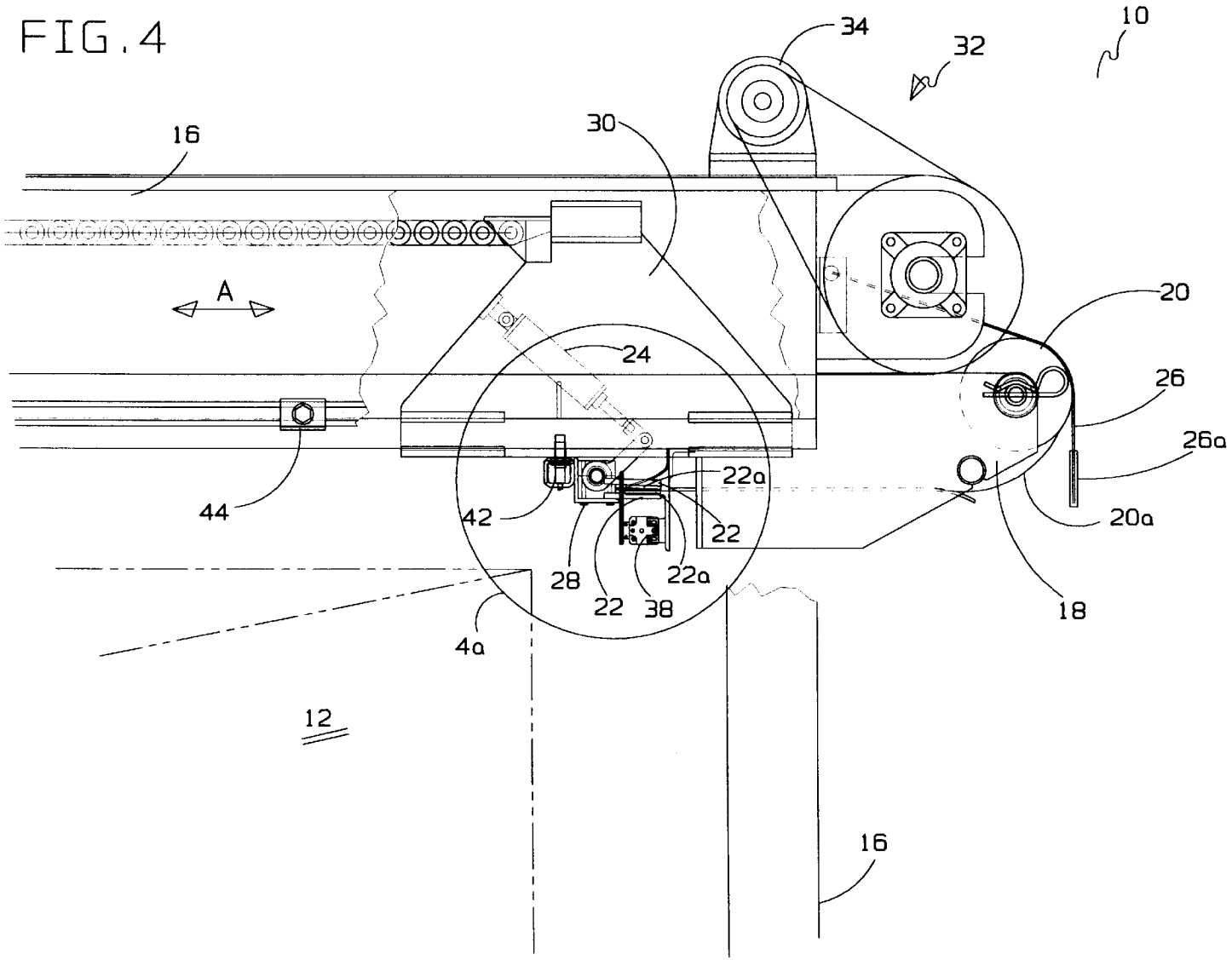
FIG. 4 is a sectional view according to the preferred embodiment of the invention of FIG. 1
Figure 4A:
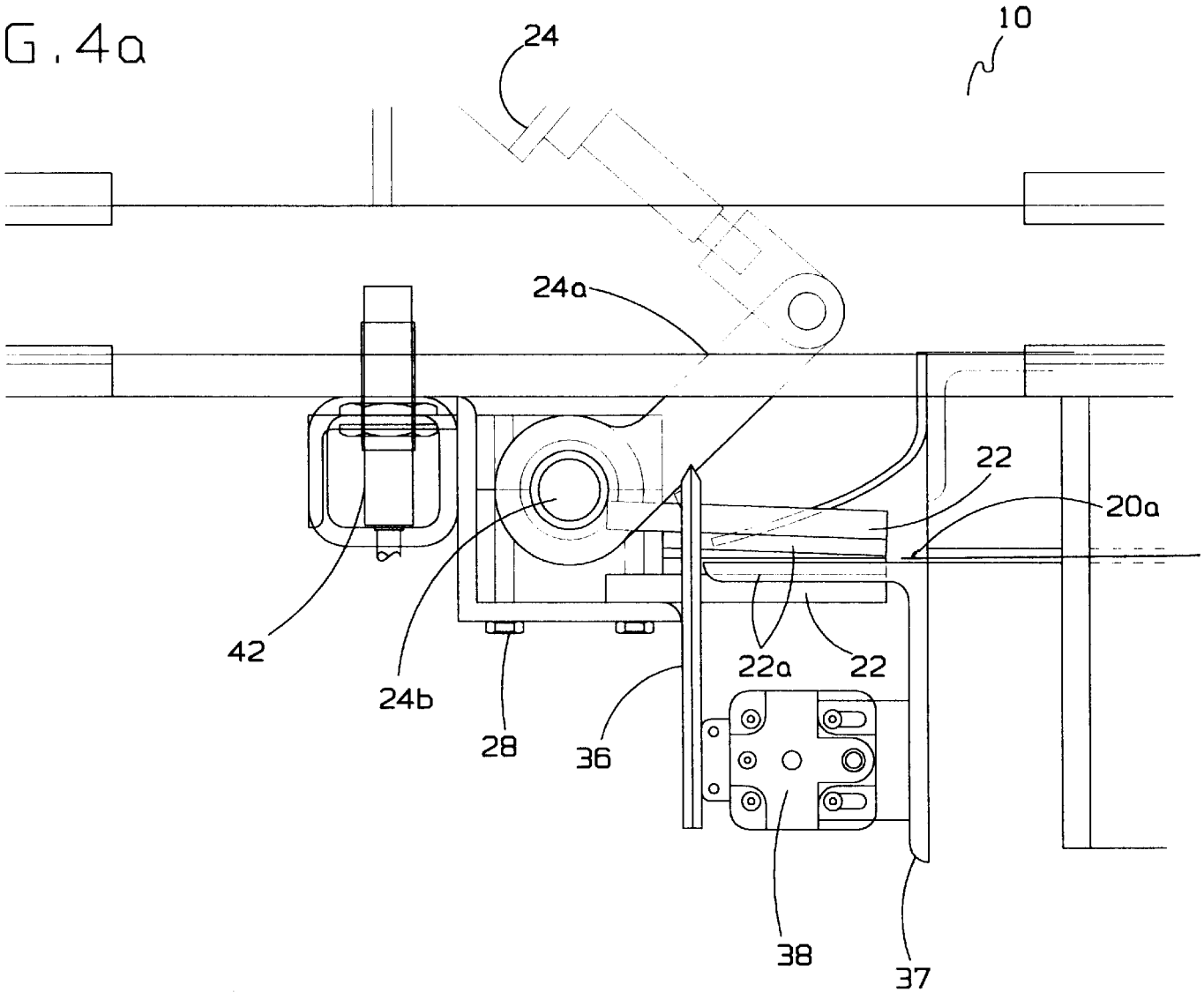
FIG. 4*a* is a sectional view of the grip clamps.
Figure 5:
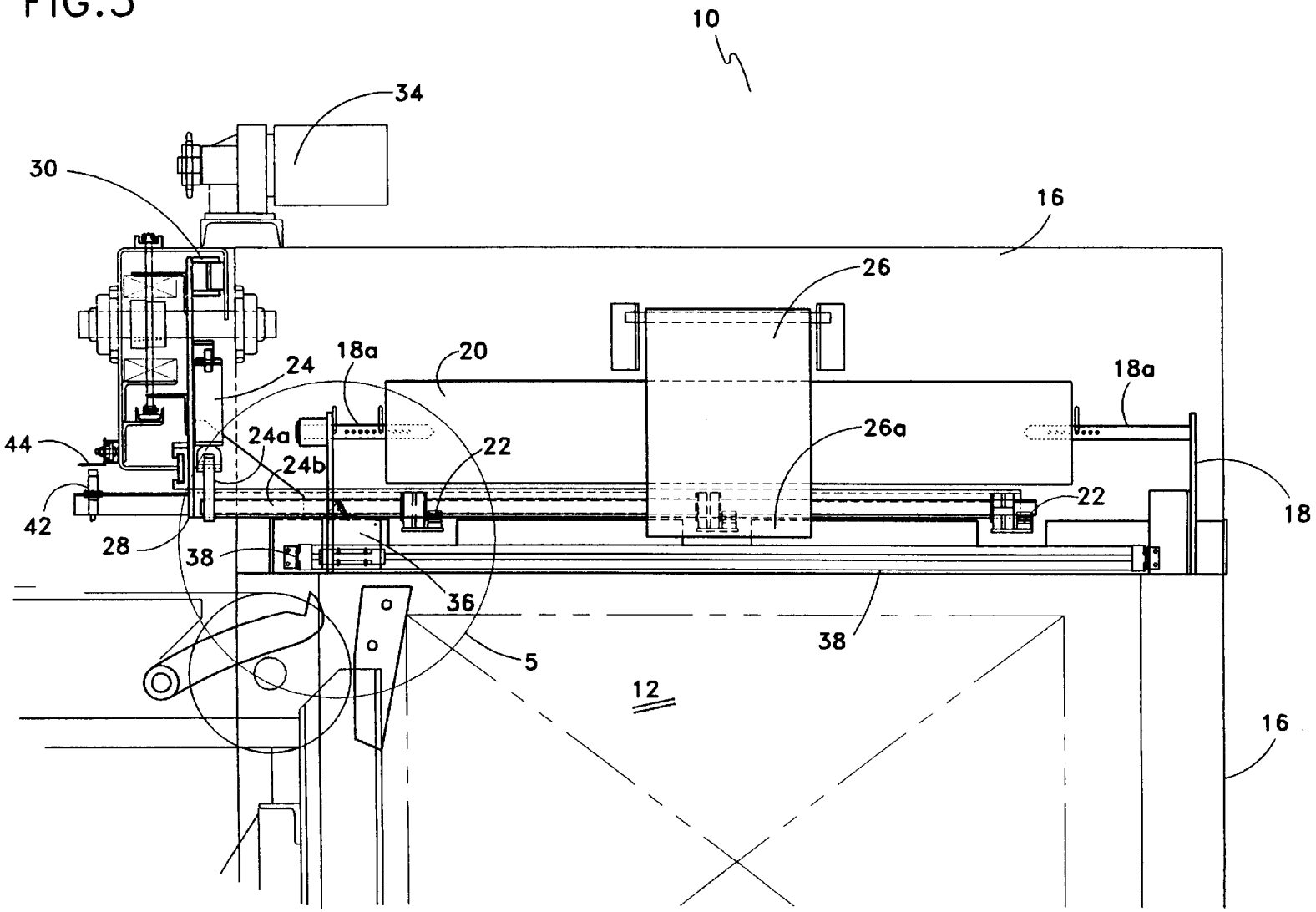
FIG. 5 is a sectional view according to a preferred embodiment of the invention of FIG. 2.

As seen in FIGS. 1–3, lumber package 12 is being formed on lumber stacker 14. Poly sheet placing apparatus 10 is mounted on frame 16 positioned above the lumber package 12. As seen in FIGS. 4 and 5, poly roll holder 18 holds poly roll 20 by means of opposed pins 18*a* journalled in the roll ends of roll 20. Grip clamps 22 are actuated by air cylinder 24 so as to open and close grip clamps 22 by rotating linkage 24*a* and rod 24*b* seen better in FIG. 4*a*.

Grip clamps 22 have rubber pads 22*a* for gripping poly sheet 20*a*. Grip clamps 22 are rigidly mounted to rod 24*b*. Rod 24*b* is rotatably mounted within carriage 28. Carriage 28 is mounted on trolley 30. Trolley 30 is drawn back and forth over package 12 in direction A by drive chain 32. Drive chain 32 is driven by motor 34.

Figure 5A:
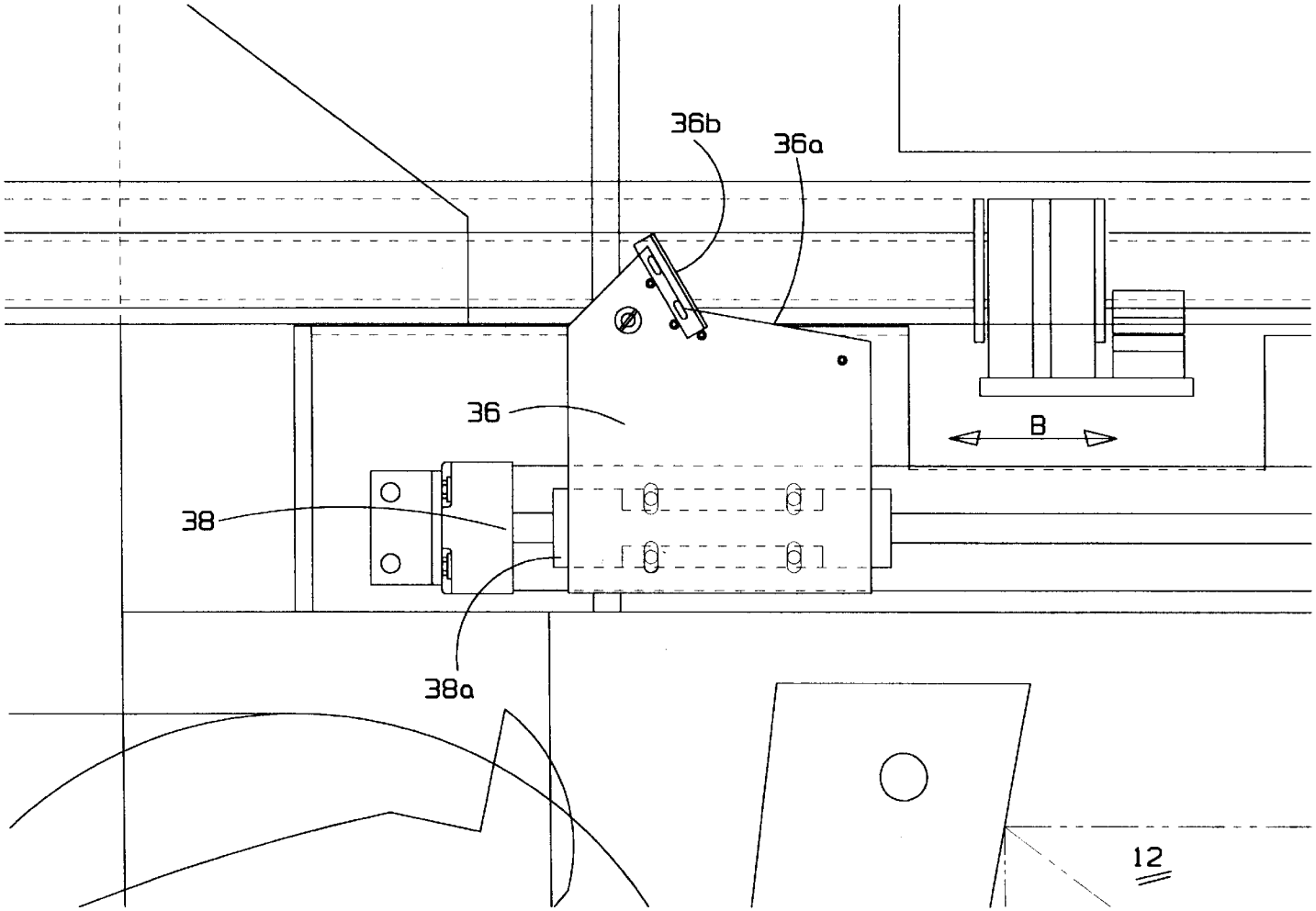
FIG. 5*a* is a side sectional view of the knife holder and carriage assembly.
Figure 6B:
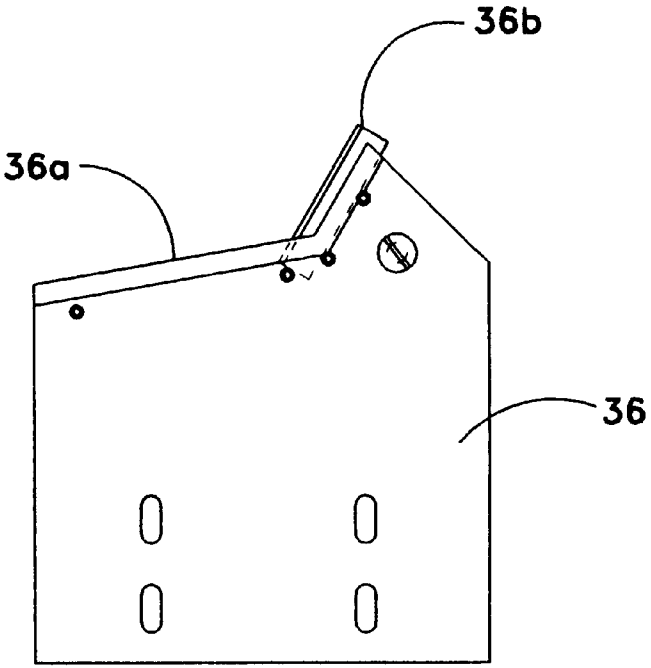
FIGS. 6*a* and 6*b* are, respectively, end elevation and side elevation of a knife holder showing a pre-tensioning means according to a preferred embodiment of the invention.
Figure 6A:
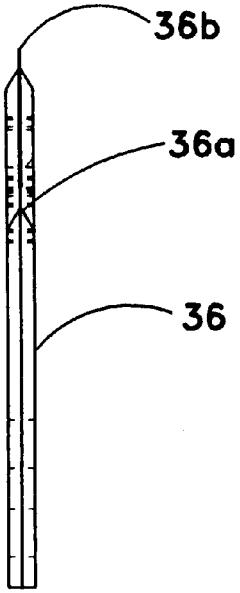

Knife holder 36 is better seen in FIGS. 5*a*, 6*a* and 6*b*. Knife holder 36 is drawn across poly sheet 20*a* in direction B by a rod-less air cylinder 38. Poly sheet pre-tension device 36*a*, that is, the leading upper edge of knife holder 36, lifts and tensions poly sheet 20*a*. Knife or razor blade 36*b* cuts poly sheet 20*a*. Poly sheet 20*a* is cut once it has been drawn by translation of trolley 30 so as to pull the desired length of poly sheet 20*a* from roll 20. Knife holder 36 is mounted to carriage 38*a* on air cylinder 38 by bolts or the like.

Air conduit 40 has nozzles 40*a* which deliver a stream of pressurized air in direction C onto the top surface of the poly sheet 20*a*.

The poly sheet 20*a* is measured to length by a sensor 42 mounted on carriage 28 which sense adjustable tabs 44. Tabs 44 are preset for the length of the lumber package. The translation of carriage 28 is stopped briefly for the time it takes knife 36*b* to cut poly sheet 20*a*.

Braking belt 26, which may be flexible, is mounted to frame 16 and is provided to dampen rolling movement of roll 20. That is, when poly sheet 20*a* is drawn over package 12 by translation of trolley 30, once the correct length has been drawn and motion of trolley 30 stops, roll 20 will have the tendency to keep on unrolling poly sheet 20*a*. Braking belt 26 dampens such rolling by means of friction, increased by weight 26*a*, between the belt and the roll.

In an alternative embodiment, the grip clamps 46 are replaced by a vacuum pad 48. The vacuum would be supplied by a vacuum conduit (not shown). Vacuum supply would be controlled with a valve 48*a* mounted on carriage 28.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A sheet placer for selectively unrolling and cutting flexible water impervious sheet over a tier of lumber on a lumber stacker, said tier of lumber having first and second opposite tier ends, comprising:

(a) means for rotatably supporting a roll of flexible water impervious sheet at said first end of said tier of lumber so as to align a free end of said roll generally parallel to said first and second ends of said tier of lumber, (b) clamping means for selectively grasping said free end of said roll across the width of said roll and selectively translating said free end of said roll over said tier of lumber between said first and second ends, (c) cutting means for cutting said water impervious sheet at said first end of said tier of lumbers (d) means for selectively directing said cutting means in cutting engagement across said water impervious sheet generally parallel to said first end of said tier of lumber, wherein said clamping means selectively translates said free end of said roll horizontally in a plane which is fixed relative to both a lumber infeed conveyer and said lumber stacker when said sheet placer is mounted over said lumber stacker so as to cooperate with said lumber stacker as said tier of lumber is loaded from said infeed conveyer onto a lumber stack on said lumber stacker and said lumber stack sequentially lowered by said lumber stacker, wherein said water impervious sheet is translated over said tier so as to generally coincide with commencement of stacking of next tier when said lumber stack has been sequentially lowered ready for sequential stacking of said next tier onto said tier on said lumber stack, whereby said water impervious sheet may be placed between a top tier and a second-from-the-top tier of said lumber stack.

2. The sheet placer of claim 1 wherein said means for selectively grasping said free end of said roll are a spaced apart array of selective clamping means spaced laterally across said free end of said roll.

3. The sheet placer of claim 2 wherein said clamping means are clam shell clamps having opposed resilient friction means mounted therein for selective clamping by said clam shell clamps onto said free end of said roll whereby said free end of said roll is selectively held within said clamping means frictionally between said opposed resilient friction means.

4. The sheet placer of claim 3 wherein said resilient friction means are resilient pads mounted to opposed interior sides of said clam shell clamps.

5. The sheet placer of claim 1 wherein said cutting means for cutting said water impervious sheet is a blade means.

6. The sheet placer of claim 5 wherein said blade means comprises a generally planar member having a leading edge thereof engageable with said water impervious sheet so as to tension said water impervious sheet over said leading edge and so as to engage a blade mounted on said blade means in co-planar relationship with said leading edge with said water impervious sheet tensioned by said leading edge when said blade means is translated in cutting engagement across said water impervious sheet.

7. The sheet placer of claim 6 wherein said leading edge and said blade are contiguous and form first and second angles respectively relative to a plane containing said water impervious sheet and wherein said first angle is less than said second angle.

8. The sheet placer of claim 1 wherein said cutting means comprises a hot wire.

9. The sheet placer of claim 1 further comprising anti-billowing means for flattening said water impervious sheet onto said tier of lumber as said free end of said roll is translated between said first and second ends of said tier of lumber.

10. The sheet placer of claim 9 wherein said anti-billowing means comprises air directing means for directing pressurized air onto a surface of said water impervious sheet opposite to said tier of lumber.

11. For use on a lumber stacker, a method for selectively unrolling and cutting water impervious sheet over a tier of lumber on a lumber stacker, said tier of lumber having first and second opposite tier ends comprising the steps of:

(a) mounting a means for rotatably supporting a roll of water impervious sheet over said first end of said tier of lumber so as to align a free end of said roll so mounted generally parallel to said first and second ends of said tier of lumber, (b) selectively grasping, by clamping means, said free end of said roll and selectively translating said free end of said roll over said tier of lumber between said first and second ends, (c) cutting, by cutting means, said water impervious sheet at said first end of said tier of lumber.

(d) directing a means for selectively directing said cutting means into cutting engagement across said water impervious sheet generally parallel to said first end of said tier of lumber.

12. The method of claim 11 wherein said means for selectively grasping said free end of said roll are a spaced apart array of selective clamping means spaced laterally across said free end of said roll.

13. The method of claim 12 wherein said clamping means are clam shell clamps having opposed resilient friction means mounted therein for selective clamping by said clam shell clamps onto said free end of said roll whereby said free end of said roll is selectively held within said clamping means frictionally between said opposed resilient friction means.

14. The method of claim 13 wherein said resilient friction means are resilient pads mounted to opposed interior sides of said clam shell clamps.

15. The method of claim 11 wherein said cutting means for cutting said water impervious sheet is a blade means.

16. The method of claim 15 wherein said blade means comprises a generally planar member having a leading edge thereof engageable with said water impervious sheet so as to tension said water impervious sheet over said leading edge and so as to engage a blade mounted on said blade means in co-planar relationship with said leading edge with said water impervious sheet tensioned by said leading edge when said blade means is translated in cutting engagement across said water impervious sheet.

17. The method of claim 16 wherein said leading edge and said blade are contiguous and form first and second angles respectively relative to a plane containing said water impervious sheet and wherein said first angle is less than said second angle.

18. The method of claim 11 wherein said cutting means comprises a hot wire.

19. The method of claim 11 further comprising the step of flattening said water impervious sheet onto said tier of lumber by anti-billowing means as said free end of said roll is translated between said first and second ends of said tier of lumber.

20. The method of claim 19 wherein said anti-billowing means comprises air directing means and said flattening comprises directing pressurized air onto a surface of said water impervious sheet opposite to said tier of lumber from said air directing means.

21. A sheet placer for selectively unrolling and cutting water impervious sheet over a tier of lumber on a lumber stacker, said tier of lumber having first and second opposite tier ends, comprising:

(a) means for rotatably supporting a roll of water impervious sheet over said first end of said tier of lumber so as to align a free end of said roll generally parallel to said first and second ends of said tier of lumber, (b) clamping means for selectively grasping said free end of said roll and selectively translating said free end of said roll over said tier of lumber between said first and second ends, (c) cutting means for cutting said water impervious sheet at said first end of said tier of lumber, (d) means for selectively directing said cutting means in cutting engagement across said water impervious sheet generally parallel to said first end of said tier of lumber, and wherein said blade means comprises a generally planar member having a leading edge thereof engageable with said water impervious sheet so as to tension said water impervious sheet over said leading edge and so as to engage a blade mounted on said blade means in co-planar relationship with said leading edge with said water impervious sheet tensioned by said leading edge when said blade means is translated in cutting engagement across said water impervious sheet.

22. The sheet placer of claim 21 wherein said leading edge and said blade are contiguous and form first and second angles respectively relative to a plane containing said water impervious sheet and wherein said first angle is less than said second angle.

23. A sheet placer for selectively unrolling and cutting water impervious sheet over a tier of lumber on a lumber stacker, said tier of lumber having first and second opposite tier ends, comprising:

(a) means for rotatably supporting a roll of water impervious sheet over said first end of said tier of lumber so as to align a free end of said roll generally parallel to said first and second ends of said tier of lumber, (b) clamping means for selectively grasping said free end of said roll and selectively translating said free end of said roll over said tier of lumber between said first and second ends, (c) cutting means for cutting said water impervious sheet at said first end of said tier of lumber, (d) means for selectively directing said cutting means in cutting engagement across said water impervious sheet generally parallel to said first end of said tier of lumber, and (e) anti-billowing means for flattening said water impervious sheet onto said tier of lumber as said free end of said roll is translated between said first and second ends of said tier of lumber.

24. The sheet placer of claim 23 wherein said anti-billowing means comprises air directing means for directing pressurized air onto a surface of said water impervious sheet opposite to said tier of lumber.

25. For use on a lumber stacker, a method for selectively unrolling and cutting water impervious sheet over a tier of lumber on a lumber stacker, said tier of lumber having first and second opposite tier ends, comprising the steps of:

(a) mounting a means for rotatably supporting a roll of water impervious sheet over said first end of said tier of lumber so as to align a free end of said roll so mounted generally parallel to said first and second ends of said tier of lumber, (b) selectively grasping, by clamping means, said free end of said roll and selectively translating said free end of said roll over said tier of lumber between said first and second ends, (c) cutting, by cutting means, for cutting said water impervious sheet at said first end of said tier of lumber, (d) directing a means for selectively directing said cutting means into cutting engagement across said water impervious sheet generally parallel to said first end of said tier of lumber, and wherein said blade means comprises a generally planar member having a leading edge thereof engageable with said water impervious sheet so as to tension said water impervious sheet over said leading edge and so as to engage a blade mounted on said blade means in co-planar relationship with said leading edge with said water impervious sheet tensioned by said leading edge when said blade means is translated in cutting engagement across said water impervious sheet.

26. The method of claim 25 wherein said leading edge and said blade are contiguous and form first and second angles respectively relative to a plane containing said water impervious sheet and wherein said first angle is less than said second angle.

27. For use on a lumber stacker, a method for selectively unrolling and cutting water impervious sheet over a tier of lumber on a lumber stacker, said tier of lumber having first and second opposite tier ends, comprising the steps of:

(a) mounting a means for rotatably supporting a roll of water impervious sheet over said first end of said tier of lumber so as to align a free end a said roll so mounted generally parallel to said first and second ends of said tier of lumber, (b) selectively grasping, by clamping means, said free end of said roll and selectively translating said free end of said roll over said tier of lumber between said first and second ends, (c) cutting, by cutting means, for cutting said water impervious sheet at said first end of said tier of lumber, (d) directing a means for selectively directing said cutting means into cutting engagement across said water impervious sheet generally parallel to said first end of said tier of lumber, and (e) flattening said water impervious sheet onto said tier of lumber by anti-billowing means as said free end of said roll is translated between said first and second ends of said tier of lumber.

28. The method of claim 27 wherein said anti-billowing means comprises air directing means and said flattening comprises directing pressurized air onto a surface of said water impervious sheet opposite to said tier of lumber from said air directing means.

* * * * *